US006672531B1

(12) United States Patent
Erlandson

(10) Patent No.: US 6,672,531 B1
(45) Date of Patent: Jan. 6, 2004

(54) FOIL TAPE DISPENSING DEVICE

(76) Inventor: Kenneth R. Erlandson, 870 County Rd. 110 North, Minnetrista, MN (US) 55364

( * ) Notice: Subject to any disclaimer, the term of this patent is extended or adjusted under 35 U.S.C. 154(b) by 0 days.

(21) Appl. No.: 10/208,686

(22) Filed: Jul. 31, 2002

(51) Int. Cl.[7] ..... B65H 85/67
(52) U.S. Cl. ..... 242/588; 156/579
(58) Field of Search ..... 242/588; 156/574, 156/577, 579

(56) References Cited

U.S. PATENT DOCUMENTS 3,969,181 A * 7/1976 Seabold ..... 156/577
4,089,730 A * 5/1978 Mahn ..... 156/577
4,574,030 A * 3/1986 Pilcher ..... 156/577
4,880,490 A * 11/1989 MacIntyre ..... 156/577
6,098,690 A * 8/2000 Robichaud ..... 156/577

* cited by examiner

*Primary Examiner*—William A. Rivera

(57) ABSTRACT

A foil tape dispensing device for dispensing aluminum foil tape used for sealing ductwork. The foil tape dispensing device includes a housing having first and second side walls, a top wall and front and back end walls, and also having a compartment disposed therein, and further having an opening being disposed through the first side wall and into the compartment; and also includes a handle being attached to the housing; and further includes an assembly of dispensing foil tape from the housing; and also includes a cutting member being attached to the housing for severing selected lengths of foil tape.

3 Claims, 4 Drawing Sheets

FOIL TAPE DISPENSING DEVICE

BACKGROUND OF THE INVENTION

1. Field of the Invention

The present invention relates to tape dispensers and more particularly pertains to a new foil tape dispensing device for dispensing aluminum foil tape used for sealing ductwork.

2. Description of the Prior Art

The use of tape dispensers is known in the prior art. More specifically, tape dispensers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes inventions having housings, spools mounted in the housings, and cutting members mounted to the housings for severing the tape from the roll of tape. While these devices fulfill their respective, particular objectives and requirements, the aforementioned prior art do not disclose a new foil tape dispensing device.

SUMMARY OF THE INVENTION

The general purpose of the present invention, which will be described subsequently in greater detail, is to provide a new foil tape dispensing device which has many of the advantages of the tape dispensers mentioned heretofore and many novel features that result in a new foil tape dispensing device which is not anticipated, rendered obvious, suggested, or even implied by any of the prior art tape dispensers, either alone or in any combination thereof. The present invention includes a housing having first and second side walls, a top wall and front and back end walls, and also having a compartment disposed therein, and further having an opening being disposed through the first side wall and into the compartment; and also includes a handle being attached to the housing; and further includes an assembly of dispensing foil tape from the housing; and also includes a cutting member being attached to the housing for severing selected lengths of foil tape. None of the prior art includes the combination of elements of the present invention.

There has thus been outlined, rather broadly, the more important features of the foil tape dispensing device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should, not be regarded as limiting.

It is an object of the present invention to provide a new foil tape dispensing device which has many of the advantages of the tape dispensers mentioned heretofore and many novel features that result in a new foil tape dispensing device which is not anticipated, rendered obvious, suggested, or even implied by any of the prior art tape dispensers, either alone or in any combination thereof.

Still another object of the present invention is to provide a new foil tape dispensing device for dispensing aluminum foil tape used for sealing ductwork.

Still yet another object of the present invention is to provide a new foil tape dispensing device that is easy and convenient to use.

Even still another object of the present invention is to provide a new foil tape dispensing device that effectively separates the tape backing from the tape itself.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
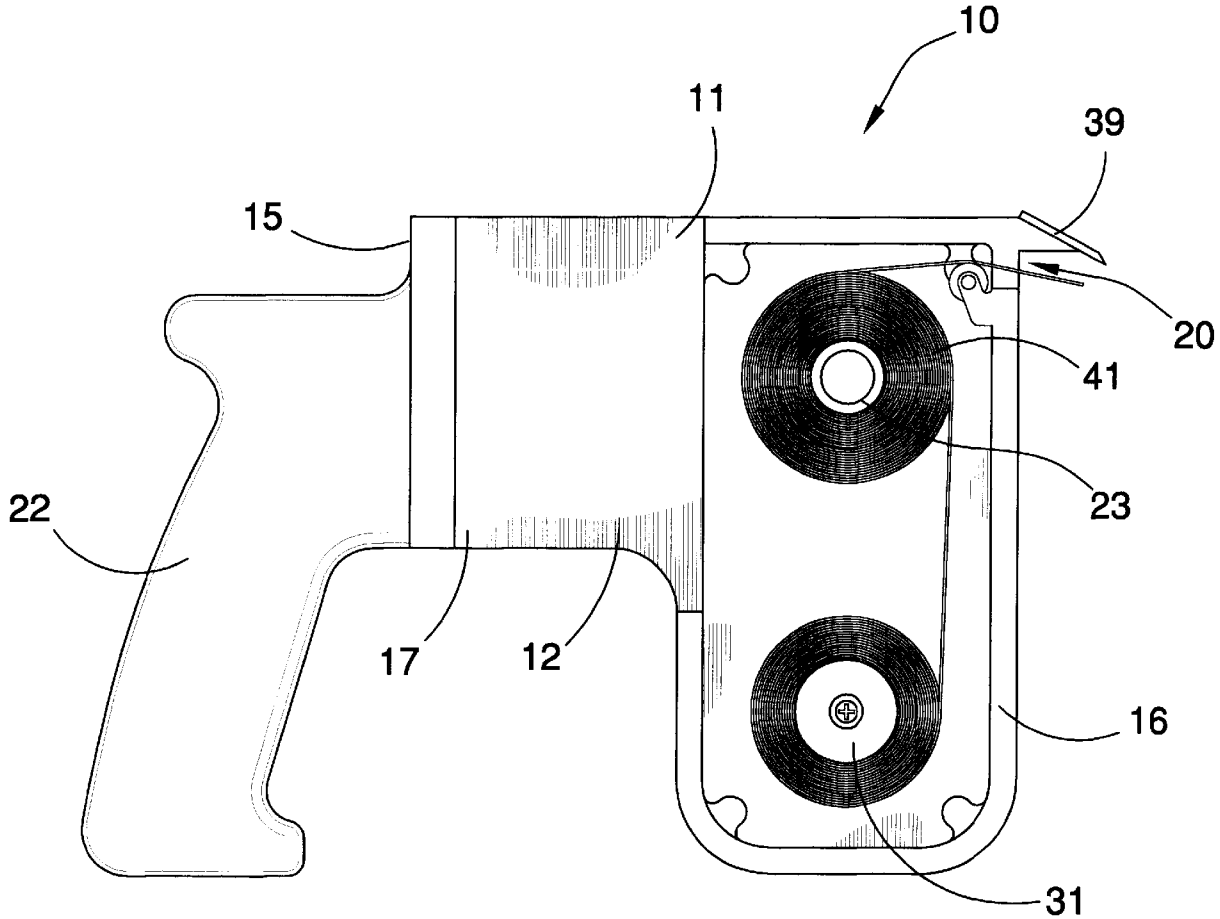
FIG. 1 is a first side elevational view of a new foil tape dispensing device according to the present invention.
Figure 2:
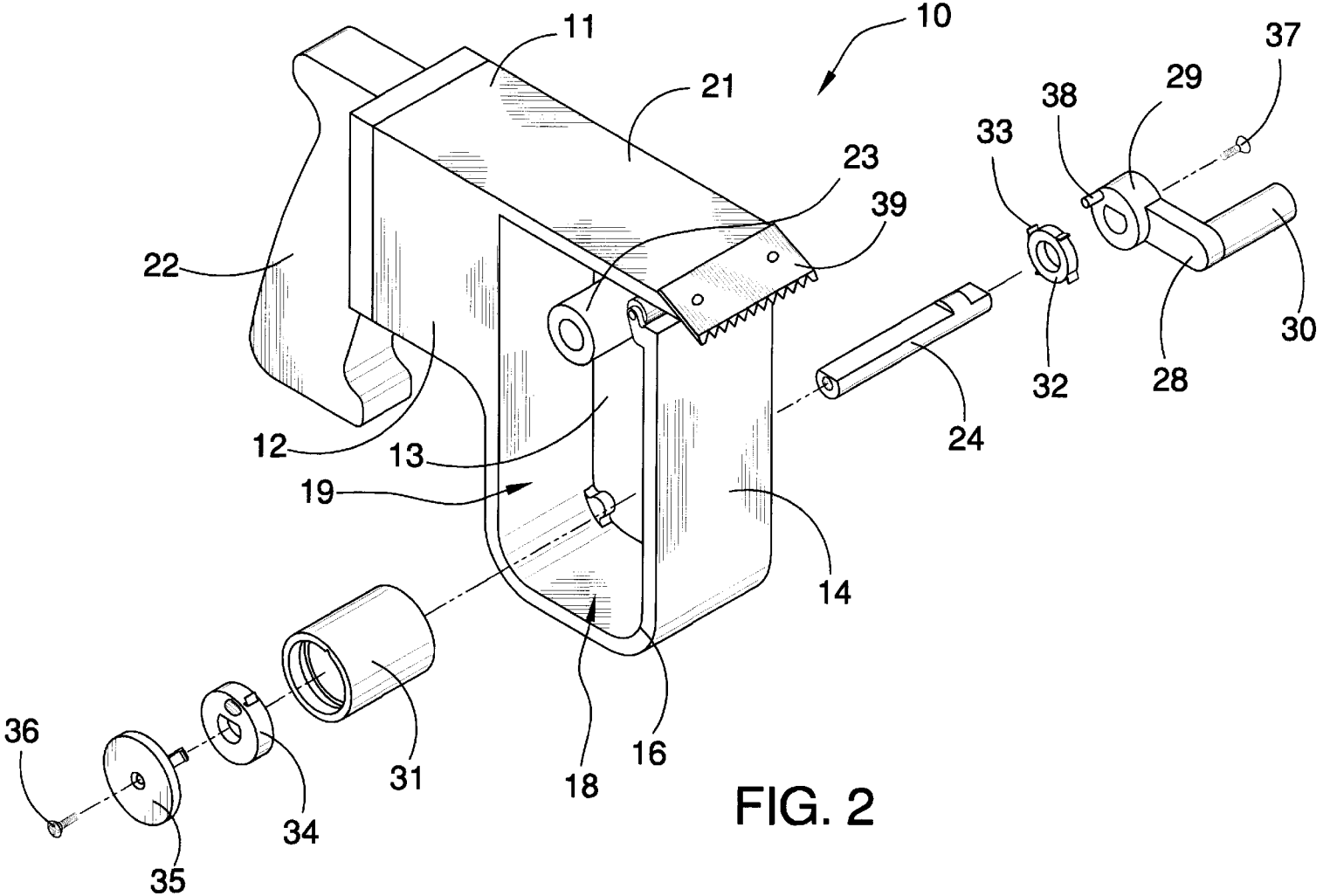
FIG. 2 is an exploded perspective view of the present invention.
Figure 3:
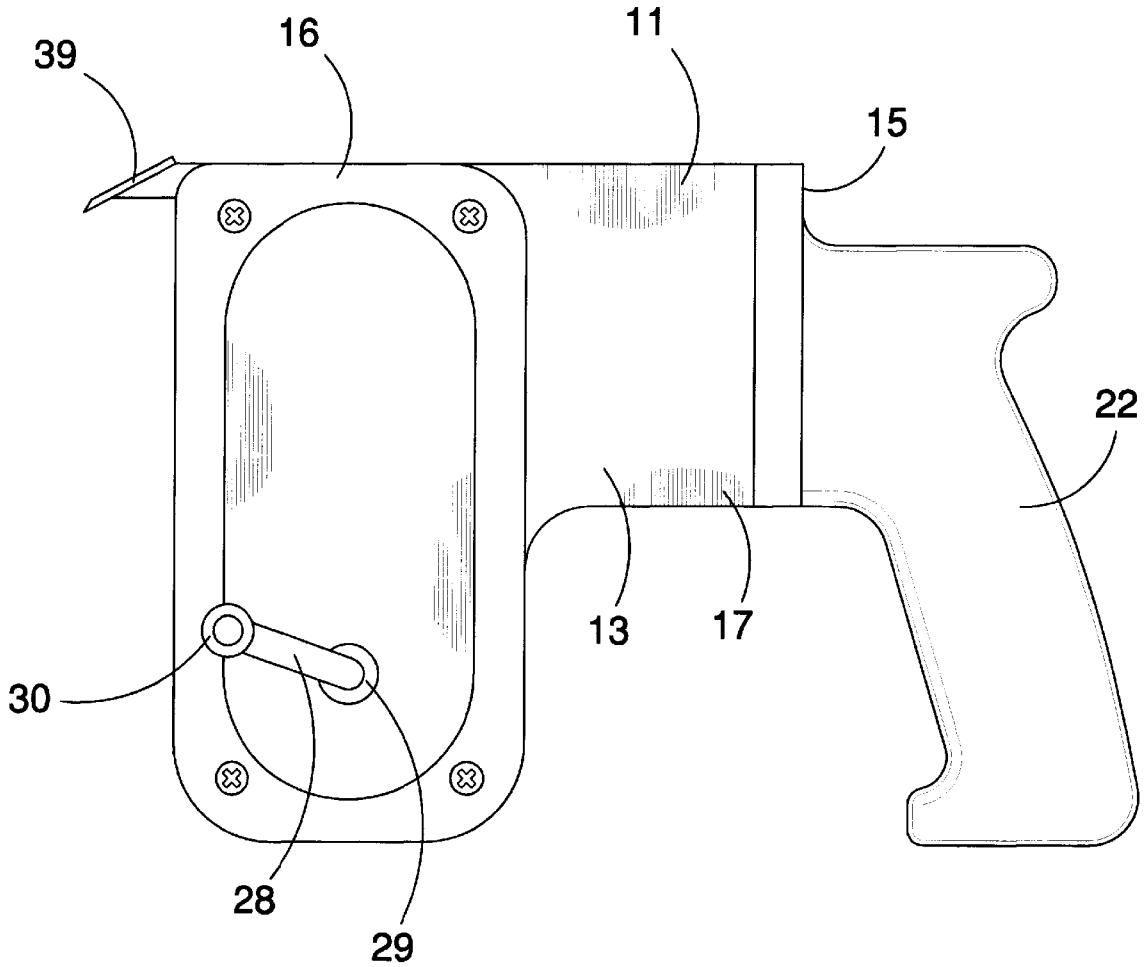
FIG. 3 is a second side elevational view of the present invention.
Figure 4:
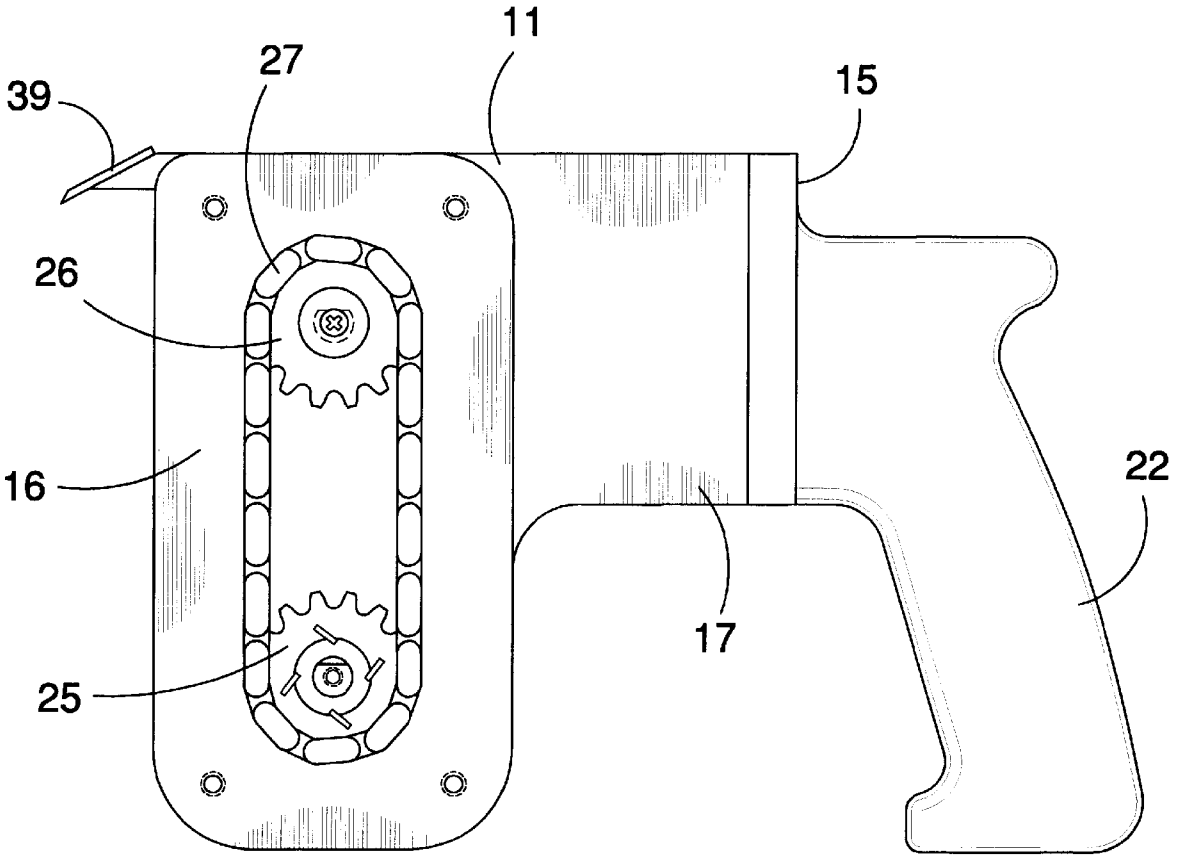
FIG. 4 is a second side elevational view of the present invention with the cover being removed.

With reference now to the drawings, and in particular to FIGS. 1 through 4 thereof, a new foil tape dispensing device embodying the principles and concepts of the present invention and generally designated by the reference numeral 10 will be described.

As best illustrated in FIGS. 1 through 4, the foil tape dispensing device 10 generally comprises a housing 11 having first and second side walls 12,13, a top wall 21 and front and back end walls 14,15, and also having a compartment 19 disposed therein, and further having an opening 18 being disposed through the first side wall 12 and into the compartment 19. The housing 11 has a laterally-extending opening 20 being disposed through the front end wall 14 near a top thereof for dispensing the foil tape from the housing 11. The housing 11 has a front portion 16 and a back portion 17 with the compartment 19 being disposed in the front portion 16.

A handle 22 is conventionally attached to the housing 11. The handle 22 is integrally attached to the back end wall 15 of the housing 11, and is shaped like that of a handle of a handgun.

A means of dispensing foil tape 41 from the housing 11 includes a tape dispensing spool 23 being journaled through the second wall 13 and being disposed in the compartment 19 of the housing 11, and further includes a tape-backing rollup assembly also being mounted to the housing 11. The tape-backing rollup assembly includes a first sprocket 26 being conventionally mounted to the tape-dispensing spool 23, and also includes a rotatable shaft 24 being journaled through the second wall 13 and being disposed in the compartment 19 of the housing 11, and further includes a second sprocket 25 being conventionally mounted to the rotatable shaft 24, and also includes a crank 28 being detachably attached to the rotatable shaft 24 for keeping the tape-backing taut, and further includes an endless chain 27 being carried about the first and second sprockets 25,26, and also includes a cover [40] (not shown) being removably fastened upon the second wall 13 of the housing 11 and enclosing and protecting the first and second sprockets 25,26. The crank 28 includes an eyelet portion 29 and a handle portion 30 with the rotable shaft 24 being removably engaged in the eyelet portion 29 and with the crank 28 being fastened with a fastener 37 to the rotatable shaft 24. The crank 28 further includes a lug member 38 being conventionally attached to the eyelet portion 29.

A tape-backing spool 31 is conventionally mounted to the rotatable shaft 24 in the compartment 19. A tension coiled spring 34 is removably disposed in the tape-backing spool 31 and about the rotatable shaft 24 to provide tension to the tape-backing about the tape-backing spool 31. An endcap 35 is fastened with a fastener 36 to an outer end of the rotatable shaft 24. An anti-spring back member 32 is mounted to the rotatable shaft 24 and is engagable to the lug member to keep the tape-backing taut about said tape-backing spool 31. The anti-spring back member 32 is disc-shaped having a hole centrally-disposed therethrough and also having fin members 33 being extended and angled outwardly from a circumferential edge thereof and being engagable to the lug member 38 to keep the tape-backing taut about said tape-backing spool 31. A cutting member 39 is conventionally fastened to the housing 11 for severing selected lengths of foil tape 41. The cutting member 39 is attached at an end of the top wall 21 of the housing 11, and is spaced from the laterally-extending opening 20 of the housing 11, and is a blade having a serrated edge for cutting the foil tape 41.

In use, the user loads a roll of foil tape about the tape-dispensing spool 23 and extends a section of the tape through the laterally-extending opening 20 and wraps the tape backing about the tape-backing spool 31. The user then pulls upon the tape through the laterally-extending opening 20 which causes the tape-dispensing spool 23 to rotate thus causing the first and second sprockets 25,26 to rotate with the tape-backing being taken up by the tape-backing spool 31 as the tape is pulled through the laterally-extending opening 20; whereupon, the user severs a selected length of tape by cutting it upon the serrated edge of the cutting member 39.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the foil tape dispensing device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foil tape dispensing device comprising:

a housing having first and second side walls, a top wall and front and back end walls, and also having a compartment disposed therein, and further having an opening being disposed through said first side wall and into said compartment, said housing having a laterally-extending opening being disposed through one of said front end wall near a top thereof for dispensing the foil tape from said housing, said housing having a front portion and a back portion, said compartment being disposed in said front portion;

a handle being attached to said housing;

a means of dispensing foil tape from said housing including a tape-dispensing spool beings journaled through said second wall and being disposed in said compartment of said housing, and further including a tape-backing rollup assembly also being mounted to said housing, said tape-backing rollup assembly including a first sprocket being mounted to said tape-dispensing spool, and further including a rotatable shaft being journaled through said second wall and being disposed in said compartment of said housing, and also including a second sprocket being mounted to said rotatable shaft, and further includes a crank being detachably attached to said rotatable shaft for keeping the tape-backing taut, and also includes an endless chain being carried about said first and second sprockets, and further including a tape-backing spool being mounted to said rotatable shaft in said compartment, and further including a coiled spring being removably disposed in said tape-backing spool and about said rotatable shaft to provide tension to the tape-backing about the tape-backing spool, and also including an endcap being fastened with a fastener to an outer end of said rotatable shaft, and further including an anti-spring back member being mounted to said rotatable shaft and being engageable to said lug member to keep the tape-backing taut about said tape-backing spool; and a cutting member being attached to said housing for severing selected lengths of foil tape.

2. A foil tape dispensing device as described in claim 1, wherein said crank includes an eyelet portion and a handle portion with said rotatable shaft being removably engaged in said eyelet portion and with said crank being fastened to said rotatable shaft, said crank further including a lug member being attached to said eyelet portion.

3. A foil tape dispensing device as described in claim 2, wherein said anti-spring back member is disc-shaped having a hole centrally-disposed therethrough and also having fin members being extended and angled outwardly from a circumferential edge thereof and being engageable to said lug member to keep the tape-backing taut about said tape-backing spool.

* * * * *